US011414360B2

(12) United States Patent
Lamy-Bracq et al.

(10) Patent No.: US 11,414,360 B2
(45) Date of Patent: Aug. 16, 2022

(54) EFFICIENT SMOKE COMPOSITION IN VISIBLE AND INFRARED RANGES

(71) Applicant: NEXTER MUNITIONS, Versailles (FR)

(72) Inventors: Peggy Lamy-Bracq, Bourges (FR); Yohan Dufour, Bourges (FR)

(73) Assignee: NEXTER MUNITIONS, Versailles (FR)

( * ) Notice: Subject to any disclaimer, the term of this patent is extended or adjusted under 35 U.S.C. 154(b) by 866 days.

(21) Appl. No.: 16/091,371

(22) PCT Filed: Mar. 27, 2017

(86) PCT No.: PCT/FR2017/050701
§ 371 (c)(1),
(2) Date: Oct. 4, 2018

(87) PCT Pub. No.: WO2017/174895
PCT Pub. Date: Oct. 12, 2017

(65) Prior Publication Data

US 2019/0152874 A1 May 23, 2019

(30) Foreign Application Priority Data

Apr. 4, 2016 (FR) ..... 1600574

(51) Int. Cl.
*C06D 3/00* (2006.01)

(52) U.S. Cl.
CPC ..... *C06D 3/00* (2013.01)

(58) Field of Classification Search
None
See application file for complete search history.

(56) References Cited

U.S. PATENT DOCUMENTS

| | | | | |
|---|---|---|---|---|
| 4,447,278 | A | 5/1984 | Sedat | |
| 4,698,108 | A | 10/1987 | Vega et al. | |
| 5,389,308 | A | 2/1995 | Busel et al. | |
| 2005/0199323 | A1* | 9/2005 | Nielson | F42B 12/44 149/19.3 |

(Continued)

FOREIGN PATENT DOCUMENTS

| | | | |
|---|---|---|---|
| DE | 2451701 | A1 | 5/1976 |
| DE | 300 420 | A5 | 6/1992 |

(Continued)

OTHER PUBLICATIONS

Aug. 22, 2017 International Search Report issued in International Patent Application No. PCT/FR2017/0507001.

(Continued)

*Primary Examiner* — Aileen B Felton
(74) *Attorney, Agent, or Firm* — Oliff PLC

(57) ABSTRACT

A smoke composition which is effective in the visible and infrared ranges and includes at least one oxidant and at least one reducing agent and at least one smoke agent generating carbon particles. This composition has superchlorinated polyvinyl chloride (C-PVC) as smoke agent, wherein the chlorine content of this smoke agent is between 57% and 70% of the weight of superchlorinated polyvinyl chloride, wherein the composition has 49% to 90% by weight of superchlorinated polyvinyl chloride (C-PVC) based on the total weight of the composition.

12 Claims, 4 Drawing Sheets

(56) References Cited

U.S. PATENT DOCUMENTS

Figure 1A:
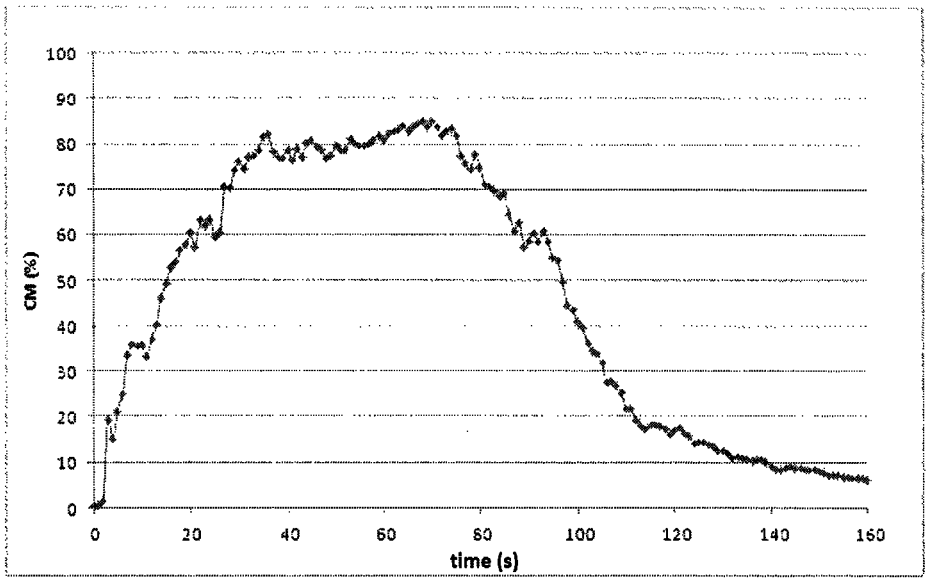

2012/0060468 A1* 3/2012 Dushku ..... F02K 9/32
60/255

FOREIGN PATENT DOCUMENTS

| | | | |
|---|---|---|---|
| DE | 10 2007 019968 | A1 | 10/2008 |
| EP | 0 072 276 | A1 | 2/1983 |
| EP | 0 639 547 | A1 | 2/1995 |
| FR | 2583037 | A1 | 12/1986 |

OTHER PUBLICATIONS

Aug. 22, 2017 Written Opinion of the International Searching Authority issued in International Patent Application No. PCT/FR2017/050701.
Jan. 11, 2017 Search Report issued in French Patent Application No. 1600574.
Jan. 11, 2017 Written Opinion issued in French Patent Application No. 1600574.

* cited by examiner

EFFICIENT SMOKE COMPOSITION IN VISIBLE AND INFRARED RANGES

The technical field of the invention is that of pyrotechnic smoke compositions to provide masking in the visible and infrared ranges.

Smokes covering a broad spectrum of masking have long been known. By a "broad spectrum of masking" is meant masking which is effective with respect to radiation from the visible range to the far infrared, i.e. a wavelength of 0.4 μm to 14 μm.

Patent FR2583037 thus discloses a composition combining an oxidant, a reducing agent and a carbon particle generator consisting of a chlorinated aromatic compound. This composition is very effective from the point of view of masking, both for the visible spectrum and for the infrared range with a range of 3-5 μm and 8-12 μm. However, it has the disadvantage of implementing a substance, chlorinated naphthalene, which is today banned from manufacturing and use by the European Union.

There is a need to define, for the protection of land and naval forces, new pyrotechnic masking compositions that can provide masking in a wide spectral range while only using low toxicity components.

It is the object of the invention to provide a new range of pyrotechnic compositions that may be made from materials presenting little or no risk and yet offering a certain broadband masking efficiency.

The composition proposed by the invention also generates fumes of reduced toxicity.

Thus, the object of the invention is an effective smoke composition in the visible and infrared ranges comprising at least one oxidant and at least one reducing agent and at least one smoke agent generating carbon particles, wherein this composition is characterized in that it comprises superchlorinated polyvinyl chloride (C-PVC) as a smoke agent, wherein the chlorine content of this smoke agent is between 57% and 70% of the superchlorinated polyvinyl chloride weight, wherein the composition comprises 49% to 90% by weight of superchlorinated polyvinyl chloride (C-PVC) relative to the total weight of the composition.

It was known to use polyvinyl chloride (PVC) as a binder in pyrotechnic compositions. This material is, indeed, a plastic material in common use that may be easily combined with other components by carrying out granulation in the presence of a solvent. Usually, the PVC is dissolved in a solvent and then mixed with the other constituents to form a coating. Then the composition is granulated and dried.

The patent DE2451701 thus discloses a smoke composition based on chlorinated paraffin that may be coated in a polymeric binder such as PVC or vinyl acetate. This binder makes it possible to improve the mechanical strength of the composition and it is used in moderate proportions (content less than 30% of the total weight).

The patent DE102007019968 does not describe a smoke composition but a pyrotechnic energy composition, for example an ignition composition combining magnesium, ammonium or potassium perchlorate and a binder. This document mentions PVC as a prior art conventional binder in the production of pyrotechnic compositions. When PVC is thus used as a binder of a pyrotechnic composition, it is implemented in a moderate amount (less than 30% of the total weight).

In all cases the binder described by these patents is a polyvinyl chloride and not a superchlorinated polyvinyl chloride (C-PVC).

Patents EP0639547 and U.S. Pat. No. 5,389,308 also disclose a smoke pyrotechnic composition that can generate a cloud that is opaque to infrared rays. This composition combines in the form of a tablet: 35% to 65% by weight of a particular aromatic material (such as anthraquinone, phthalic anhydride or phenothiazine), 10 to 25% by weight of magnesium powder, 5 to 35% by weight of a fluorinated polymer, and 5 to 15% by weight of chlorinated paraffin. The magnesium/fluorinated polymer combination constitutes the ignition composition of the aromatic material. This smoke composition comprises chlorinated paraffin which is a moderator of combustion. The material that generates the masking cloud is the aromatic material (anthraquinone, for example). Superchlorinated paraffin does not contribute to the masking cloud but slows down the reaction which affects the durability of the cloud. The level of chlorinated paraffin in the composition therefore remains reduced at 5% to 15% by weight compared with 35% to 65% by weight for the aromatic material forming the cloud. This document cites a single example of the use of superchlorinated PVC as a combustion moderator instead of chlorinated paraffin (superchlorinated PVC is not a chlorinated paraffin). But the function of superchlorinated PVC in this example still has the function of combustion moderator and its rate remains reduced (15% by weight).

C-PVCs result from a more or less strong substitution of hydrogen with chlorine in the chains of polyvinyl chloride (PVC). These materials may have a weight chlorine content that may range from 57% to 74%. They have the particularity of being more ductile than PVC which makes them usable in the manufacture of pipes.

A consequence of superchlorination of PVC is that it allows more chlorine to be available during the reaction. This chlorine forms with metal reducing agents metal chlorides (e.g. MgCl, $MgCl_2$, etc.) which have their own modes of vibration in the infrared wavelength ranges that are to be masked. Such an arrangement makes it possible to improve the masking.

Surprisingly and unusually, it has been found that by using a superchlorinated polyvinyl chloride (C-PVC), an aerosol is generated in a stable and sustained manner and that mainly comprises carbon particles having particle sizes between 0.8 and 10 μm to provide masking having a certain efficiency in the visible and near and far infrared ranges.

In addition, the components so generated have reduced toxicity. The main products of the combustion of this type of composition are, in fact, solid particles of carbon, metal chlorides and metal oxides. The amount of hydrogen chloride generated by the compositions with the highest chlorine content is of the order of 2 $mg/m^3$, which is well below the exposure limit value of 7.6 $mg/m^3$ mentioned by the INRS (French National Research and Safety Institute) in its technical data sheet ED 984 of July 2012. This value is also very far from the thresholds of the first lethal effects and the irreversible effects mentioned by INERIS (French National Institute for Environmental Technology and Hazards) in its 2003 data sheet indicating thresholds of 1937 $mg/m^3$ and 358 $mg/m^3$ respectively.

To ensure the combustion of C-PVC, it is necessary to combine it with a redox composition that is sufficiently energetic to allow the ignition of the composition and the maintenance of combustion thereof.

C-PVC is indeed a relatively low flammable material and must be brought to a temperature well above its decomposition temperature (180° C.) to allow a regular and maintained combustion of the composition and thus generate smoke.

The composition according to the invention thus comprises from 49% to 90% by weight of superchlorinated polyvinyl chloride (C-PVC) relative to the total weight of the composition.

C-PVC therefore does not play the role of a simple binder for a pyrotechnic composition but itself forms the smoke agent of the composition.

We can thus combine in the composition:

5% to 30% by weight of reducing agent,

5% to 29% by weight of oxidant,

49% to 90% of smoke agent,

0% to 30% of binder and

0% to 5% of additives.

The reducing agent may be chosen from the following bodies or compounds:

magnesium, aluminum, calcium silicide or their mixtures.

The oxidant may be chosen from the following compounds: potassium perchlorate (KClO4), potassium nitrate (KNO3), potassium permanganate (KMnO4), potassium periodate (KIO4), polyvinylidene fluoride (PVDF), polytetrafluoroethylene (PTFE).

A binder material may or may not be included if the implementation requires it and mainly for reasons of mechanical strength.

The binder may be chosen from the following binders: thermoplastic resins, polyurethane resin, epoxy resins, hydroxytelechelic polybutadiene (PBHT), dinitroanisole.

Dinitroanisole is an energy binder that will accelerate the burning rate of the composition to allow adjustment of the operating time of the product in which the composition is integrated. The use of thermoplastic resin is preferred for in situ implementations.

It is also possible to use additives (0 to 5% by weight). The additives may be components facilitating the implementation (flowability and compressibility), for example graphite (particle size: between 2 and 10 μm), aerosil, magnesium calcium or stearate.

Figure 1B:
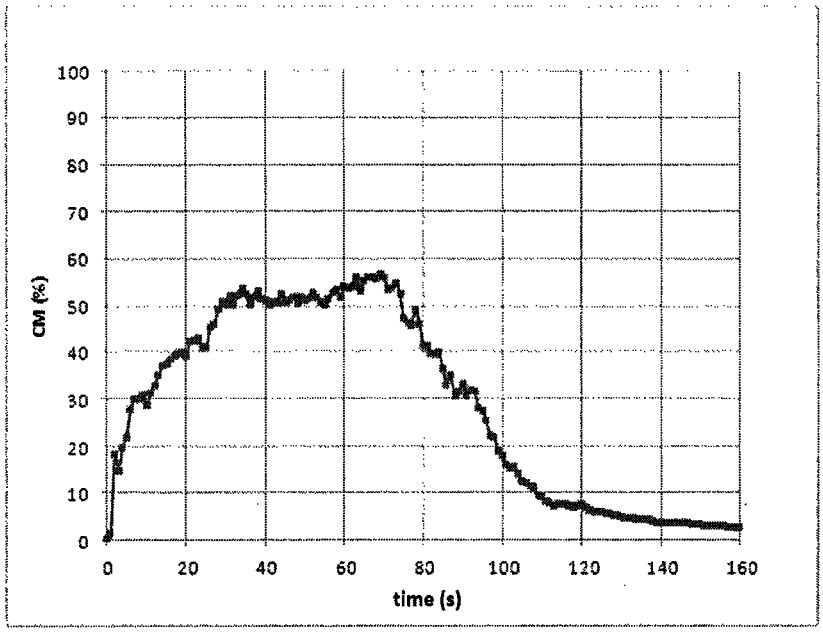
Figure 2A:
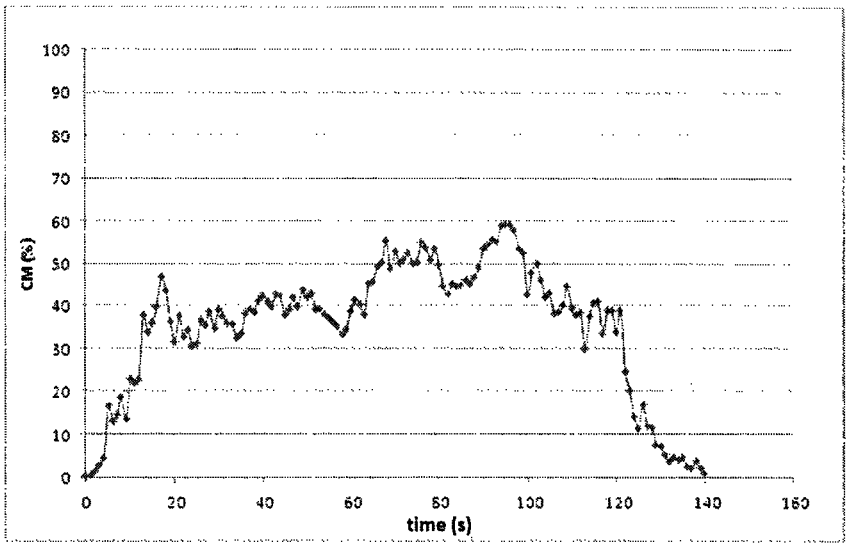
Figure 2B:
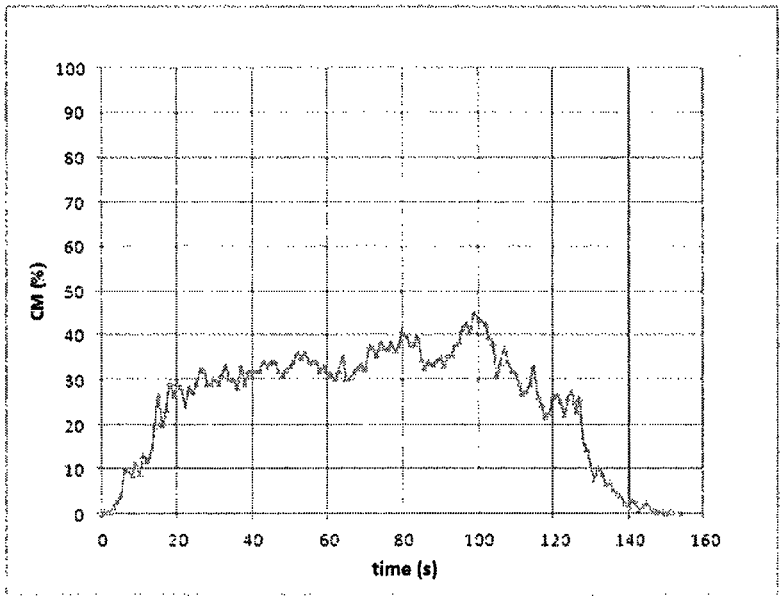
Figure 3A:
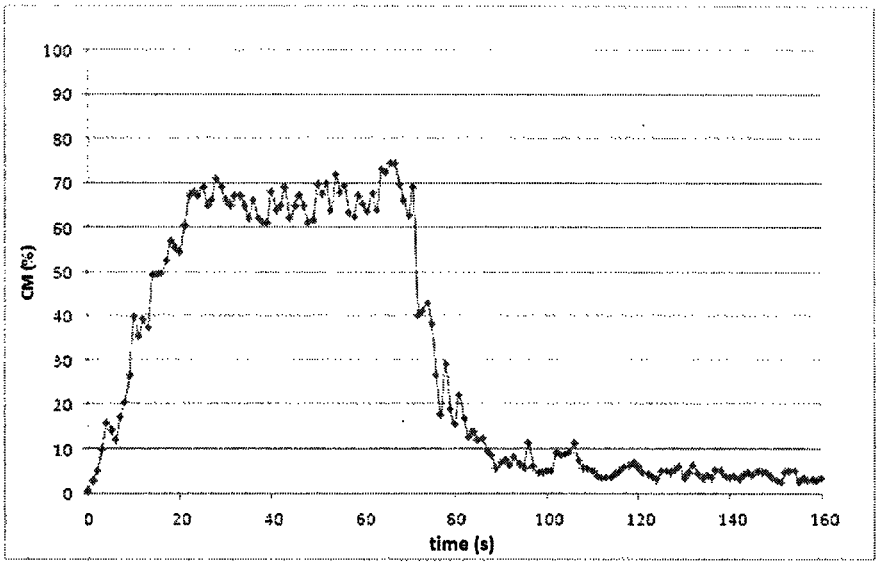
Figure 3B:
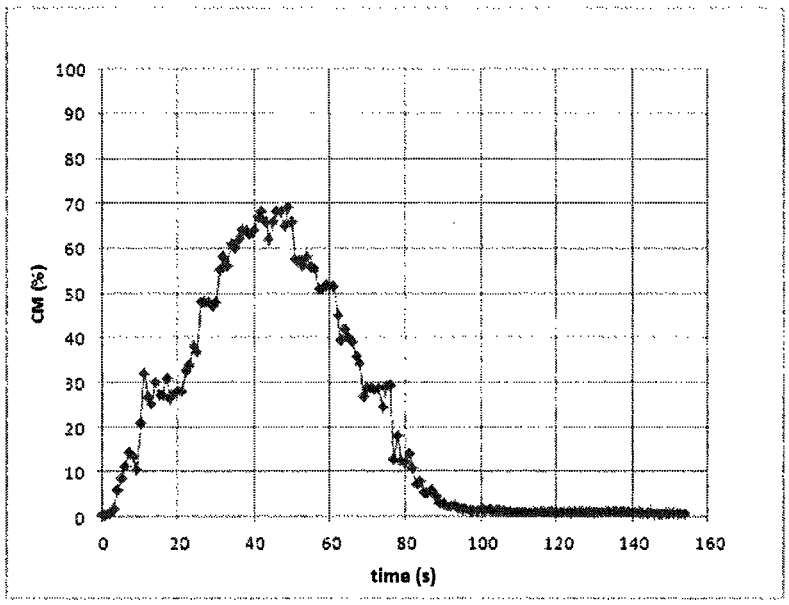
Figure 4A:
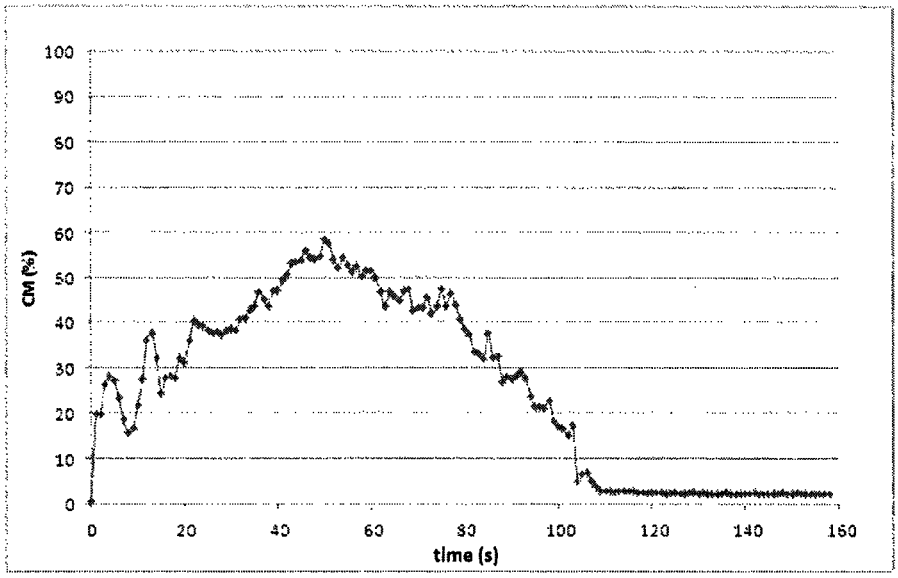
Figure 4B:
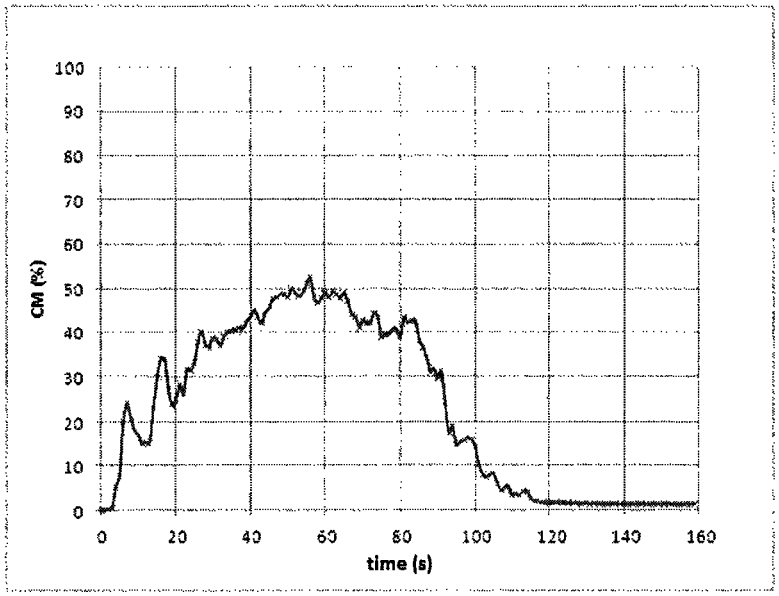

FIG. 1*a* shows the evolution of the masking coefficient for the wavelength range of 3 to 5 μm for the composition according to Example 1, wherein the abscissa axis represents the time in seconds, while the ordinate axis represents the masking coefficient in %;

FIG. 1*b* shows the evolution of the masking coefficient for the wavelength range of 8 to 12 μm for the composition according to Example 1, wherein the abscissa axis represents the time in seconds and the ordinate axis represents the masking coefficient in %;

FIG. 2*a* shows the evolution of the masking coefficient for the wavelength range of 3 to 5 μm for the composition according to Example 2, wherein the abscissa axis represents the time in seconds and the ordinate axis represents the masking coefficient in %;

FIG. 2*b* shows the evolution of the masking coefficient for the wavelength range of 8 to 12 μm for the composition according to Example 2, wherein the abscissa axis represents the time in seconds and the ordinate axis represents the masking coefficient in %;

FIG. 3*a* shows the evolution of the masking coefficient for the wavelength range of 3 to 5 μm for the composition according to Example 3, wherein the abscissa axis represents the time in seconds and the ordinate axis represents the masking coefficient in %;

FIG. 3*b* shows the evolution of the masking coefficient for the wavelength range of 8 to 12 μm for the composition according to Example 3, wherein the abscissa axis represents the time in seconds and the ordinate axis represents the masking coefficient in %;

FIG. 4*a* shows the evolution of the masking coefficient for the wavelength range of 3 to 5 μm for the composition according to Example 4, wherein the abscissa axis represents the time in seconds and the ordinate axis represents the masking coefficient in %;

FIG. 4*b* shows the evolution of the masking coefficient for the wavelength range of 8 to 12 μm for the composition according to Example 4, wherein the abscissa axis represents the time in seconds and the ordinate axis represents the masking coefficient in %.

A number of compositions according to the invention have been tested to check their masking performance in infrared wavelength ranges of both 3 to 5 μm and 8 to 12 μm.

All the compositions were made according to one or other of the following methods:

Dry way, i.e. dry mixing of the various constituents and then compression. This method is used when the composition is free of binder, i.e. for Examples 2, 3 and 4.

Wet way, i.e. mixing of solid species with the binder in liquid form, kneading, granulation and then drying. This method is used when the composition comprises a binder, i.e. for Example 1.

The infrared masking tests were carried out in a tunnel equipped with a cold source, a hot source and two thermal cameras (1 camera 3-5 μm and 1 camera 8-12 μm). The cold source is a steel plate at room temperature. The hot source is a black-body source having a temperature of about 200° C. The masking is evaluated by comparing the effect of the passage of the smoke in front of the heat sources (cold and hot) on the temperature seen by the thermal cameras.

EXAMPLE 1

The following composition was prepared (proportions of constituents relative to the total weight of the composition):

15% of magnesium

8% of potassium perchlorate,

54% of superchlorinated polyvinyl chloride,

21% of polyurethane resin,

2% of graphite.

FIG. 1*a* shows the masking performance of this composition with respect to infrared radiation in the range 3 to 5 μm.

It is found that this composition provides masking of more than 50% over a period of time of 80 seconds. By way of comparison, the composition described by the patent FR2583037 (chlorinated naphthalene carbon generator) ensures masking of approximately 60% for 40 seconds on a close configuration (substantially the same block weight).

FIG. 1*b* shows the masking performance of this same composition with respect to infrared radiation in the range 8 to 12 μm.

It is found that the masking is greater than 50% for a duration of more than 40 seconds. By way of comparison, the composition described by the patent FR2583037 (chlorinated naphthalene carbon generator) ensures masking of approximately 60% for 40 seconds on a close configuration (substantially the same block weight).

EXAMPLE 2

The following composition was prepared (proportions of constituents relative to the total weight of the composition):

20% of calcium silicide,

29% of potassium nitrate,

49% of superchlorinated polyvinyl chloride,

2% of graphite.

FIG. 2*a* shows the masking performance of this composition with respect to infrared radiation in the range 3 to 5 μm.

It is found that this composition provides masking of more than 40% over a period of time of 70 seconds.

FIG. 2*b* shows the masking performance of this same composition with respect to infrared radiation in the range 8 to 12 μm.

It is found that the masking is greater than 30% for a duration of more than 80 seconds.

These performances are less than those of the composition according to Example 1 in terms of masking performance but remain interesting. The masking time is greater.

EXAMPLE 3

The following composition was prepared (proportions of constituents relative to the total weight of the composition):

20% of magnesium

10% of potassium perchlorate,

70% of superchlorinated polyvinyl chloride.

FIG. 3*a* shows the masking performance of this composition with respect to infrared radiation in the range 3 to 5 μm.

It is found that this composition provides masking of more than 65% over a period of time of 50 seconds.

FIG. 3*b* shows the masking performance of this same composition with respect to infrared radiation in the range 8 to 12 μm.

It is found that the masking is greater than 30% for a duration of more than 50 seconds.

EXAMPLE 4

The following composition was prepared (proportions of constituents relative to the total weight of the composition):

20% of magnesium

20% of potassium perchlorate,

60% of superchlorinated polyvinyl chloride.

FIG. 4*a* shows the masking performance of this composition with respect to infrared radiation in the range 3 to 5 μm.

It is found that this composition provides masking of more than 40% over a period of time of 60 seconds.

FIG. 4*b* shows the masking performance of this same composition with respect to infrared radiation in the range 8 to 12 μm.

It is found that the masking is greater than 30% for a duration of more than 70 seconds.

The masking performances obtained (in terms of rate and duration) are interesting.

The invention claimed is:

1. A smoke composition comprising at least one oxidant, at least one reducing agent, and at least one smoke agent generating carbon particles comprising, superchlorinated polyvinyl chloride, wherein a chlorine content of the superchlorinated polyvinyl chloride is between 57% and 70% of the weight of the superchlorinated polyvinyl chloride, wherein the composition comprises 49% to 90% by weight of the superchlorinated polyvinyl chloride relative to the total weight of the composition, and wherein upon combustion, the smoke composition provides masking in the visible and infrared ranges.

2. The smoke composition according to claim 1, wherein the smoke composition comprises 5% to 30% by weight of reducing agent, 5% to 29% by weight of oxidant, 0% to 30% of binder and 0% to 5% of additives.

3. The smoke composition according to claim 2, wherein the reducing agent is selected from the group consisting of the following bodies or compounds: magnesium, aluminum, calcium silicide and mixtures thereof.

4. The smoke composition according to claim 3, wherein the oxidant is selected from the group consisting of the following compounds: potassium perchlorate ($KClO_4$), potassium nitrate ($KNO_3$), potassium permanganate ($KMnO_4$), potassium periodate ($KIO_4$), polyvinylidene fluoride (PVDF), and polytetrafluoroethylene (PTFE).

5. The smoke composition according to claim 2, wherein the binder is present and is selected from the group consisting of thermoplastic resins, polyurethane resin, epoxy resins, hydroxytelechelic polybutadiene (PBHT), dinitroanisole, and mixtures thereof.

6. The smoke composition according to claim 3, wherein the binder is present and is selected from the group consisting of thermoplastic resins, polyurethane resin, epoxy resins, hydroxytelechelic polybutadiene (PBHT), dinitroanisole, and mixtures thereof.

7. The smoke composition according to claim 4, wherein the binder is present and is selected from the group consisting of thermoplastic resins, polyurethane resin, epoxy resins, hydroxytelechelic polybutadiene (PBHT), dinitroanisole, and mixtures thereof.

8. The smoke composition according to claim 1, wherein the smoke composition comprises (proportions relative to the total weight of the smoke composition):

15% of magnesium,

8% of potassium perchlorate,

54% of superchlorinated polyvinyl chloride,

21% of polyurethane resin, and

2% of graphite.

9. The smoke composition according to claim 1, wherein the smoke composition comprises (proportions relative to the total weight of the smoke composition):

20% of calcium silicide,

29% of potassium nitrate,

49% of superchlorinated polyvinyl chloride, and

2% of graphite.

10. The smoke composition according to claim 1, wherein the smoke composition comprises (proportions with respect to the total weight of the smoke composition):

20% of magnesium,

10% of potassium perchlorate, and

70% of superchlorinated polyvinyl chloride.

11. The smoke composition according to claim 1, wherein the smoke composition comprises (proportions relative to the total weight of the smoke composition):

20% of magnesium,

20% of potassium perchlorate, and

60% of superchlorinated polyvinyl chloride.

12. The smoke composition according to claim 1, wherein upon combustion the superchlorinated polyvinyl chloride generates an aerosol of carbon particles having particle sizes between 0.8 to 10 μm.

* * * * *